US005950390A

United States Patent [19]

Jones

[11] Patent Number: 5,950,390

[45] Date of Patent: Sep. 14, 1999

[54] PRE-CAST CONCRETE BUILDING MODULE

[76] Inventor: Jack Jones, P.O. Box 447, St. Helen, Mich. 48656

[21] Appl. No.: 09/062,683

[22] Filed: Apr. 20, 1998

[51] Int. Cl.[6] ..... E04B 1/04

[52] U.S. Cl. ..... 52/602; 52/600; 52/319; 52/582.1; 52/405.3

[58] Field of Search ..... 52/270, 271, 405.1, 52/405.3, 600, 601, 602, 309.17, 582.1, 587.1, 319

[56] References Cited

U.S. PATENT DOCUMENTS

| | | | |
|---|---|---|---|
| 948,215 | 2/1910 | Fitzpatrick . | |
| 2,043,697 | 6/1936 | Deichmann | 52/602 |
| 2,053,873 | 9/1936 | Niederhofer | 52/602 |
| 2,139,623 | 12/1938 | Marston | 52/602 |
| 2,202,745 | 5/1940 | Muse | 52/602 |
| 2,272,659 | 2/1942 | Daley | 52/319 |
| 2,741,908 | 4/1956 | Swanson | 52/602 |
| 2,769,332 | 11/1956 | Brown | 52/602 |
| 2,850,892 | 9/1958 | Stump | 52/602 |
| 3,328,932 | 7/1967 | Cheskin | 52/323 |
| 3,352,079 | 11/1967 | Strong | 52/577 |
| 3,475,529 | 10/1969 | Lacy | 52/602 |
| 3,845,593 | 11/1974 | Zen | 52/601 X |
| 4,597,237 | 7/1986 | Celli | 52/601 |
| 4,640,854 | 2/1987 | Radtke | 52/601 X |
| 4,702,048 | 10/1987 | Millman | 52/169 |
| 5,129,203 | 7/1992 | Romero | 52/309.17 X |
| 5,222,338 | 6/1993 | Hull et al. | 52/405 |
| 5,396,747 | 3/1995 | Breuning | 52/516 |

*Primary Examiner*—Carl D. Friedman
*Assistant Examiner*—Phi Dieu Tran A
*Attorney, Agent, or Firm*—John J. Swartz

[57] ABSTRACT

A pre-cast one-piece concrete building module including a concrete panel having a face with a plurality of weight-saving cavities formed therein and a concrete frame integral with the cavity forming face of the panel. The frame includes a longitudinally spaced apart main end beams spanned by a plurality of laterally spaced apart secondary beams. A plurality of concrete reinforcing ribs are disposed between the end beams and formed integrally with the cavity forming face of the panel and adjacent secondary beams. The reinforcing rib has a concave surface extending between the secondary beams and is preferably of a parabolic shape.

33 Claims, 7 Drawing Sheets

PRE-CAST CONCRETE BUILDING MODULE

BACKGROUND OF THE INVENTION

1. Field of the Invention

This invention relates to a concrete building module and more particularly, to a one-piece pre-cast concrete building module having a framed concrete panel provided with weight reducing cavities therein and a new and novel reinforcing rib integral with the panel to strengthen the module.

2. Description of the Prior Art and Objects

Concrete is an excellent building material which has many excellent building characteristics such as strength, durability, and permanence. One of the draw backs of concrete is its weight. Numerous attempts have been made to reduce weight such as that illustrated in U.S. Pat. No. 5,396,747 issued to Jorgen I. Breuning on Mar. 14, 1995, U.S. Pat. No. 4,702,048 issued to Paul Millman on Oct. 27, 1987, U.S. Pat. No. 4,597,237 issued to Also Celli on Jul. 1, 1986, U.S. Pat. No. 3,328,932 issued to D. B. Cheskin on Jul. 4, 1967 and U.S. Pat. No. 3,352,079 issued to J. G. Strong on Nov. 14, 1957.

One of the problems typically associated with the reduction of weight is a corresponding reduction in strength. U.S. Pat. No. 4,702,048 issued to Paul Millman on Oct. 27, 1997 discloses the concept of forming hemispherical dome shaped cavities in a concrete building. Typically, reduction in weight of a concrete wall is accompanied by a reduction in strength. A desired feature of a building module would be to have a unit which has a reduced weight and increased strength. Accordingly, it is an object of the present invention to provide a one-piece concrete building module which has a reduced weight and increased strength compared to prior building modules now in use.

Building constructions, such as that illustrated in U.S. Pat. No. 2,139,623 issued to J. E. Marston on Dec. 6, 1938 include a pre-cast hollow slab concrete construction system having a modular unit provided with a plurality of ribs separated by elliptically shaped recesses which reduce weight but the resulting construction still includes substantial weight that precludes its widespread acceptance in the building industry. Accordingly, it is another object of the present invention to provide a onepiece concrete building module which has a particular utility in the construction of the exterior building walls and floors.

It is another object of the present invention to provide a one-piece concrete building module which includes a concrete panel integral with a frame having a plurality of spaced apart beams integrally coupled by a reinforcing arch that transmits forces exerted on the concrete panel and the mid-portion of the arch as stresses on the frame.

It is another object of the present invention to provide a one-piece concrete building module having a one-piece concrete panel integrally coupled to a frame and reinforcing ribs which transmit or transfer forces from the panel to the frame.

It is a further object of the present invention to provide a one-piece concrete building module of the type described which includes at least one concrete reinforcing rib that has an inner surface integral with a concrete panel and an outer concave surface extending between adjacent spaced apart frame portions.

It is another object of the present invention to provide a building module of the type described wherein the concave surface of the reinforcing rib includes a pair of planar surfaces which diverge outwardly in a direction away from the face of the panel to which the rib is integrally coupled.

A still further object of the present invention is to provide a one-piece concrete building module of the type described including a concrete wall panel, an integral concrete frame, and at least one integral concrete reinforcing rib having an inner surface integral with the panel and an opposite, exposed parabolic surface extending between adjacent spaced apart portions of the frame.

It is still another object of the present invention to provide a one-piece concrete building module of the type described which includes a reinforcing rib having laterally outwardly diverging planar faces diverging outwardly in a direction away from the concrete building panel and integrally coupled to adjacent laterally spaced apart frame beams.

Yet another object of the present invention is to provide a one-piece concrete building module of the type described including a panel having a planar surface provided with a plurality of concavities therein, an integral concrete frame integrally coupled to the cavity defining surface and including main end beams spanned by a plurality of laterally spaced apart secondary beams, and at least one reinforcing arch extending between adjacent secondary beams and having opposite ends integrally coupled to adjacent ones of secondary beams and a reduced thickness mid-section integrally coupled to the panel.

Another object of the present invention is to provide a one-piece concrete building module of the type described in which the reinforcing rib has an outer surface which follows a parabola.

It is still another invention to provide a one-piece concrete building panel of the type described particularly adapted for use in floors and including an additional one-half, laterally outwardly extending rib which is flush with a longitudinal edge of the panel for abutting an identical rib end on an adjacent abutting floor panel.

Other objects and advantages of the present invention will become apparent to those of ordinary skill in the art as the description thereof proceeds.

SUMMARY OF THE INVENTION

A one-piece, pre-cast concrete building module comprising: a concrete panel having a face provided with a plurality of concavities formed therein, a concrete frame integrally formed with the cavity forming face and including longitudinally spaced apart main end frame members spanned by laterally spaced secondary beams, and a concrete reinforcing rib spanning the laterally spaced apart secondary beams, the concrete reinforcing rib including one face integral with the face of the concrete panel and an opposite face having surfaces which diverge outwardly in a direction away from the panel.

DESCRIPTION OF THE DRAWINGS

The invention may be more readily understood by referring to the accompanying drawings, in which.

DESCRIPTION OF PREFERRED EMBODIMENT

Figure 1:
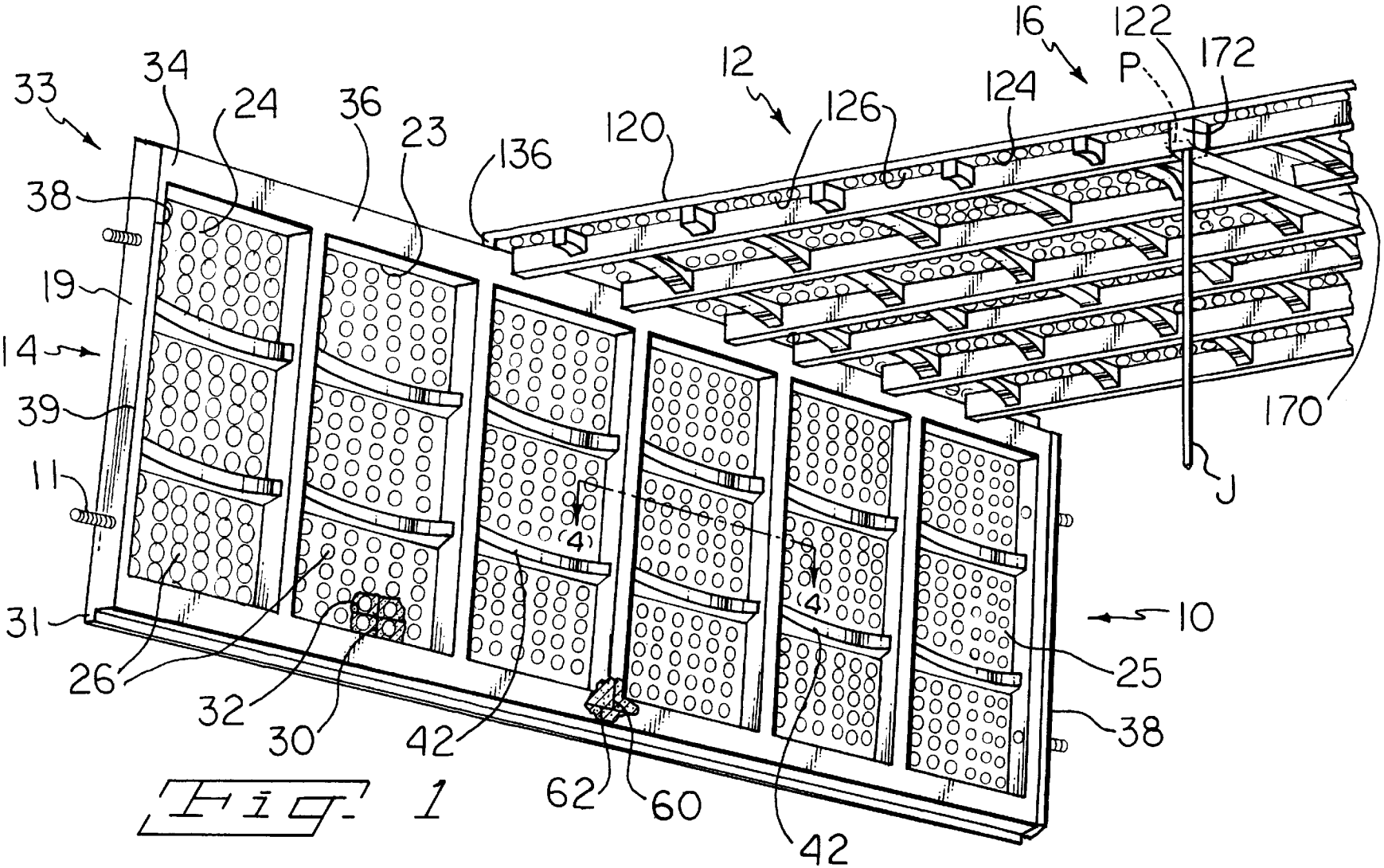
FIG. 1 is a bottom perspective view of a portion of a wall and floor building construction incorporating pre-cast concrete building modules constructed according to the present invention, part of the concrete being broken away in section to more clearly illustrate the underlying reinforcing rod.

One-piece concrete building wall and floor modules, generally designated 10 and 12, respectively, constructed according to the present invention are utilized in constructing building walls and floors 14 and 16, respectively, of a building, generally designated 18. The building modules 10 and 12 are similar in many respects. The wall 14, which is mounted on a ground embedded concrete foundation F, includes a plurality of adjacent identical building wall modular units 10 which are coupled together in abutting vertical disposed relation with suitable members such as bolts, generally designated 11, and suitable nuts. The floor 16 includes a plurality of horizontally disposed, abutting floor modules 12 which have opposite ends supported by the vertical wall modules 10.

Each one-piece concrete building module 10 includes a planar pre-cast concrete panel, generally designated 20 having an outside planar surface 22 and an inside parallel planar surface 24 which includes a plurality of weight reducing cavities 26 formed therein. The thickness or distance between the parallel panel surfaces 22 and 24 is represented by the reference character 28. The inside planar surface 24 includes laterally extending, longitudinally spaced apart terminal edge portions 23 and longitudinally extending laterally spaced apart terminal edge portions 25, having lateral edges 19, defining the perimeter of the panel 20. A steel reinforcing grid, generally designated 29, is embedded in the panel 20 and include orthogonally related reinforcing rods 30 surrounding the cavities 26.

Integrally formed with the wall panel 20 is a concrete frame, generally designated 33, comprising a one-piece continuous concrete rib, generally designated 34, including a pair of laterally extending main beams, generally designated 36, integrally formed with the laterally extending edge surfaces 23 of the panels 20 and a pair of laterally spaced apart longitudinally extending, secondary end beams 38 which are integrally formed with the panel edge portions 25. The concrete rib 34 projects in a direction outwardly away from the cavity defining panel surface 24. The laterally outer faces 39 of secondary end beams are flush with the lateral edges 19 of the concrete panel 20.

The vertically lowermost surface 27 of the bottom main beam 36 includes a laterally extending step 31 which receives the edge of the floor unit 12 and provides a shoulder 37 which bears against the edge of a floor unit 12. The ends 41 of the main beams 36 are flush with the lateral edges 19 and the outer surfaces 39 of secondary end beams 38.

The frame 33 also integrally includes a plurality of longitudinally extending, laterally spaced apart concrete sub-frame secondary beams 40, identical to the secondary end beams 38, equidistantly spaced between the secondary end beams 38 and integrally formed with the panel surface 24 and the main beams 36. The couipling bolts 11 pass through adjoining abutting secondary end beams 38 of adjacent vertical wall modules 10. The frame 33 greatly strengthens the wall panels 20 for manufacture and transport.

Integrally formed with the concrete wall panel 20 is a plurality of longitudinally spaced apart, laterally extending concrete reinforcing ribs or arches, generally designated 42, each having one planar face or side 44 integrally formed with the cavity forming side 24 of the panel 20 and an opposite concave rib surface or side, generally designated 46. Each rib 42 has opposite rib ends 48 of a predetermined thickness 50, in a direction perpendicular to and away from the panel surface 24, integrally formed with adjacent ones of the secondary beams 38 and 40. Each rib 24 also includes a central portion 52 of reduced thickness 54 in a direction perpendicular to and away from panel surface 24, which is substantially less than the rib end thickness 50.

As illustrated in the drawings, the concave surface 46 follows a parabola and thus defines a parabolic surface for the rib or arch 42 to transmit any transverse bending forces, represented by the arrows 56 exerted on the mid-portion 52 of the arch, in a direction normal to the plane of panel 20, laterally outwardly in the direction generally designated by the reference characters 58 as stresses on the secondary beams 38 and 40.

The cavities 26 are not formed in the portion of panel 20 which is coupled to the frame 33 or the reinforcing rib 42.

Embedded in the frame 33 is a steel reinforcing grid, generally designated 60, including laterally extending reinforcing rods 62, disposed in the main beams 36, integrally coupled to a plurality of longitudinally extending steel reinforcing rods 64 embedded in the secondary end beams 38.

The pre-cast concrete floor module 12 is constructed similar to the wall panel 10 and generally similar parts will be referred to by generally similar reference characters preceded by the reference character "1". The floor module 12 includes a planar concrete panel, generally designated 120, having an outer or upper planar surface 122 and an inside or lower, parallel planar surface 124 which includes a plurality of weight reducing concavities 126 formed therein. The distance between the parallel panel surfaces 122 and 124 is represented by the reference character 128.

Figure 2:
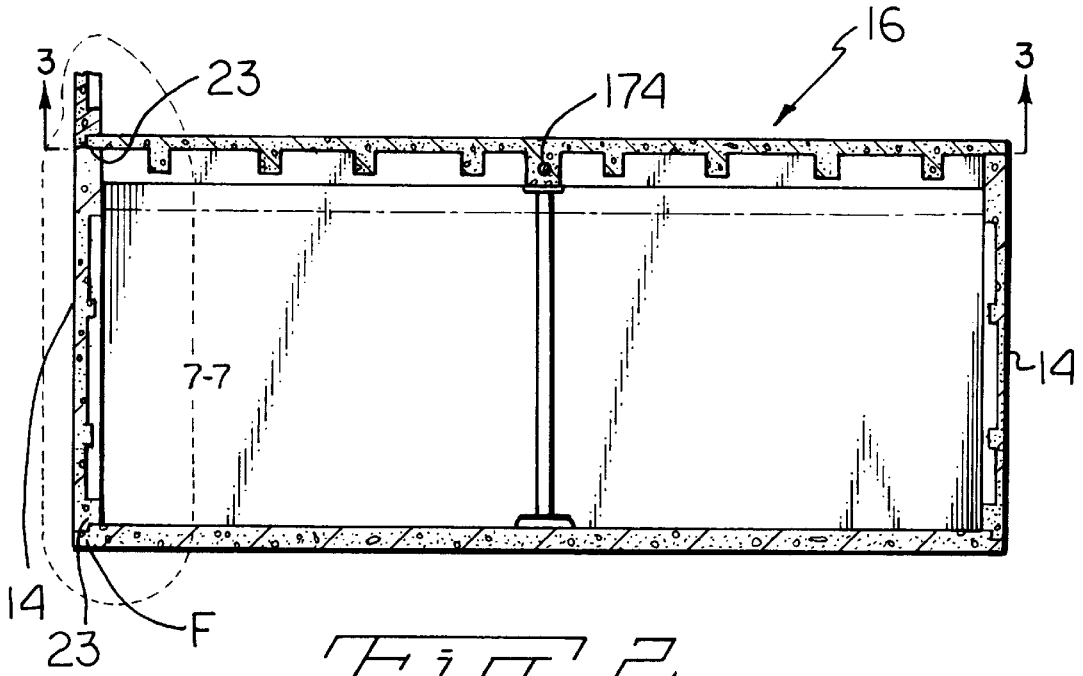
FIG. 2 is a reduced sectional side view of the wall and floor building construction, taken along the section line 2—2 of FIG. 6, illustrating the pre-cast one-piece concrete building module constructed according to the present invention.
Figure 7:
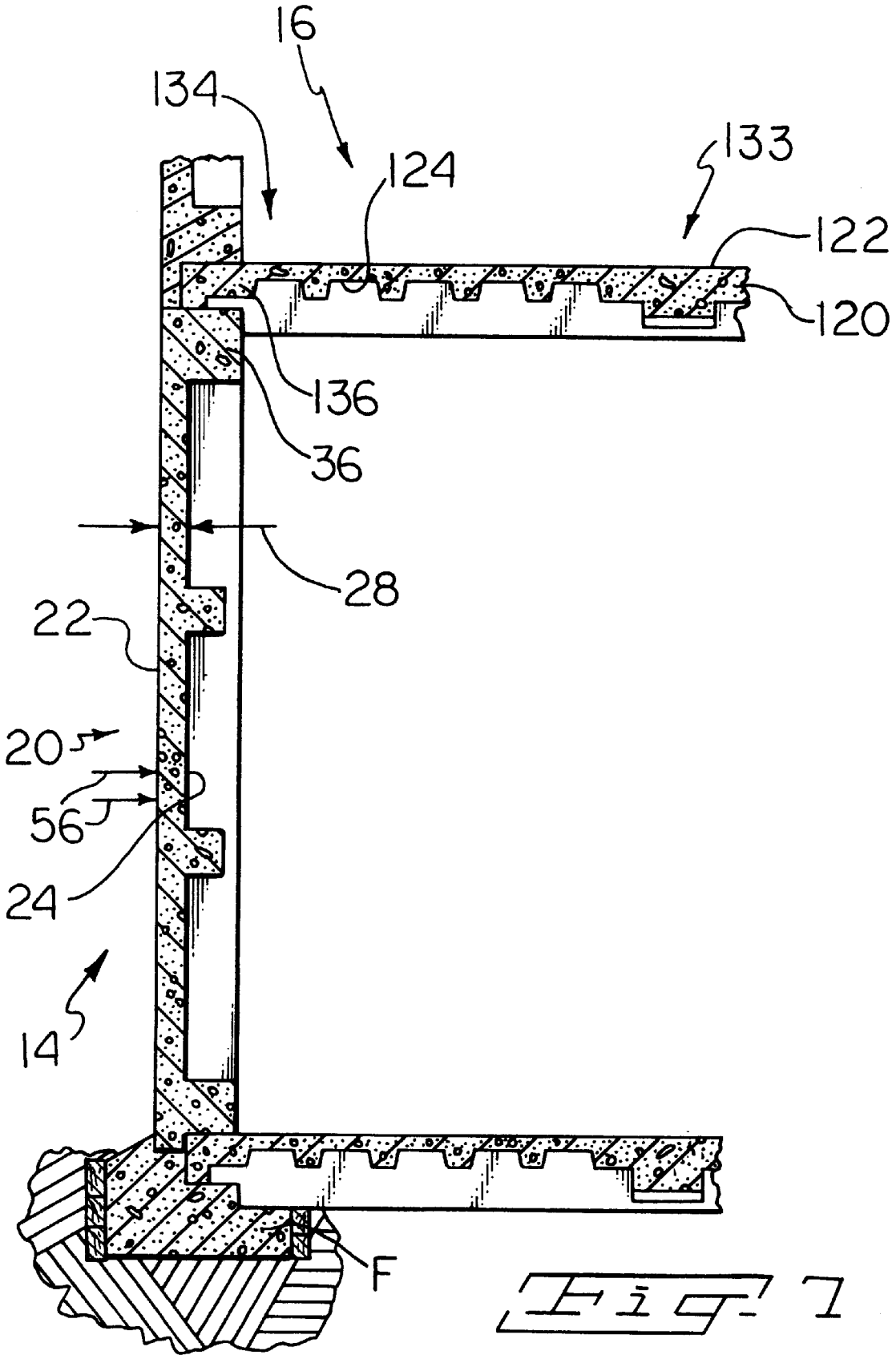
FIG. 7 is an enlarged sectional view of the portion included in the chain line circle line 7—7 of FIG. 2.

Integrally formed with the panel 120 is a concrete frame, generally designated 133, including a one-piece continuous concrete rib, generally designated 134 including a pair of laterally extending main end beams, generally designated 136, and a pair of laterally spaced apart longitudinally extending, secondary beams 140. The ends 135 of the main beams 136 are flush with the lateral edges 119 of the concrete panel 120. The floor panel 12 differs from the wall panel 10 in that the laterally outermost secondary beams 140 are spaced inwardly a distance D from the laterally outer edges 119 of the panels 120. The floor unit 12 also differs from the wall unit 10 in that the floor unit 12 includes an additional or third, centrally disposed main concrete beam 170, integrally formed with the underside 124 of the panel 120. The centrally disposed main concrete beam 170 includes ends 172 which are flush with the lateral edges 119 of the concrete panel 120. The central beam 170 is integral with the secondary beams 140 and, together with end beams 136 as illustrated in FIGS. 2 and 7 vertically support the floor modules 12. The main end beams 136 are supported by the main end beams 36 of the wall units 10. The central main beam 170 rests on vertically disposed underlying vertical metal jack posts J of conventional construction.

The length L of the floor unit 12 is substantially greater than the width W of the floor unit 12 and substantially greater than the height of the wall unit 10. The third main beam 170 reinforces or greatly strengthens the floor unit 12 which typically includes secondary beams 140 which are substantially longer than the secondary beams 38 and 40 of the wall unit 10. Whereas the wall unit 10 is a single span unit, the floor unit 12 is a double span and is not only supported at its ends by main end beams 136, but is also supported at its middle via the third main beams 170 and jack posts J.

The upper ends of the third main beam 170 and the jack posts J include upper end plates P which span the adjacent abutting ends 172 of adjacent main beams 170 floor panels 12. Reinforcing rod, typically referred to as re-rod 174, is embedded in the lower section of central beam 170 and is in tension whereas the concrete portion above the neutral axis above the beam 170 is in compression. The beam 170 is rectangularly shaped in cross section and may also be hollow if desired for weight reduction in larger slab units or to be utilized as a duct system.

The secondary beams 140 differ from the single span secondary beams 40 in that the beams 140 are a double span supported at three longitudinally spaced positions via the walls 14 and the jack posts J. A steel reinforcing grid, generally designated 129, is embedded in the panel 120 and includes orthogonal reinforcing rods 130 and 132 which surround the cavities 126. It should be understood that the shape of the cavities 26 and 126 can vary. Embedded in the one-piece frame 133 is a grid re-rod or steel reinforcing grid, generally designated 160, including laterally extending reinforcing rods 162 disposed in the main beams 136 and longitudinally extending steel reinforcing rods 164 embedded in the secondary beams 140. The re-rod 160 is disposed in the lower sections of the beams 136 and 140 and is in tension. The concrete is in compression, except over the primary beam 170.

Integrally formed with the concrete floor panels 120 is a plurality of longitudinally spaced apart, laterally extending reinforcing concrete ribs or arches, generally designated 142, having one planar side 144 integrally formed with the cavity forming side 124 of the panel 120 and an opposite concave side, generally designated 146. Each rib 148 has opposite rib ends 48 of a predetermined thickness 150, in a direction away from the panel surface 124 integrally formed with the adjacent ones of secondary beams 140 and a central portion 152 of reduced thickness 154, in a direction away from the panel surface 124 which is substantially less than the thickness 150.

As illustrated in the drawings, the concave surface 146 follows a parabola and thus defines a parabolic surface for the rib or arch 142 to transmit any downward bending forces, represented by the arrows 156, exerted on the center of the panel 120 and the mid portion 152 of the arch, in the direction, normal to the plane of panels 120, generally designated by the reference characters 158, laterally outwardly in the directions represented by the arrows 158 onto the secondary beams 140.

Figure 3:
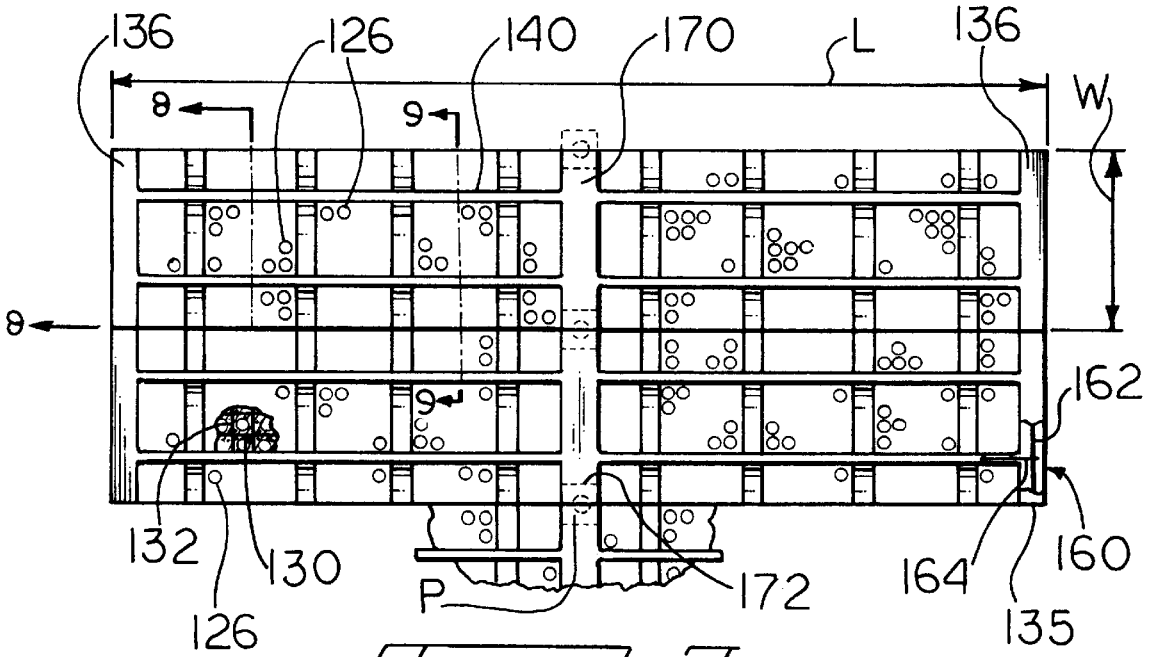
FIG. 3 is a reduced bottom plan view of the floor only, taken along the section line 3—3 of FIG. 2, part of the concrete being broken away in section to more clearly illustrate the reinforcing grids.
Figure 4:
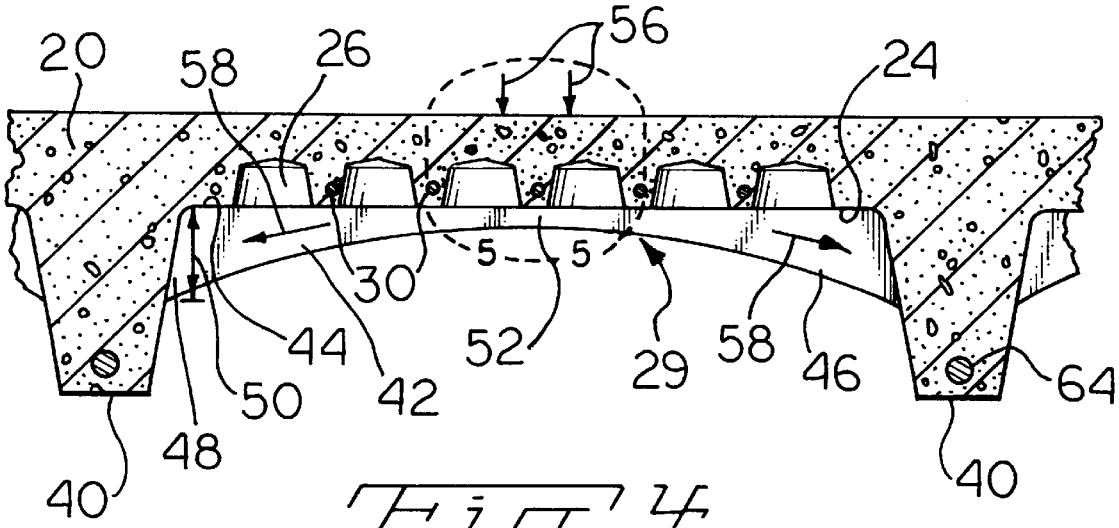
FIG. 4 is an enlarged vertical sectional view of one of a portion of a concrete wall module, taken along the section line 4—4 of FIG. 1.
Figure 5:
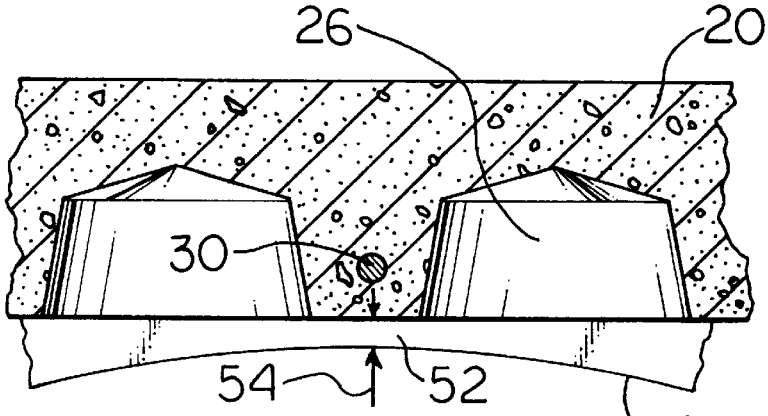
FIG. 5 is a still further enlarged sectional plan view of the portion illustrated in the chain line circle 5—5 of FIG. 4.
Figure 6:
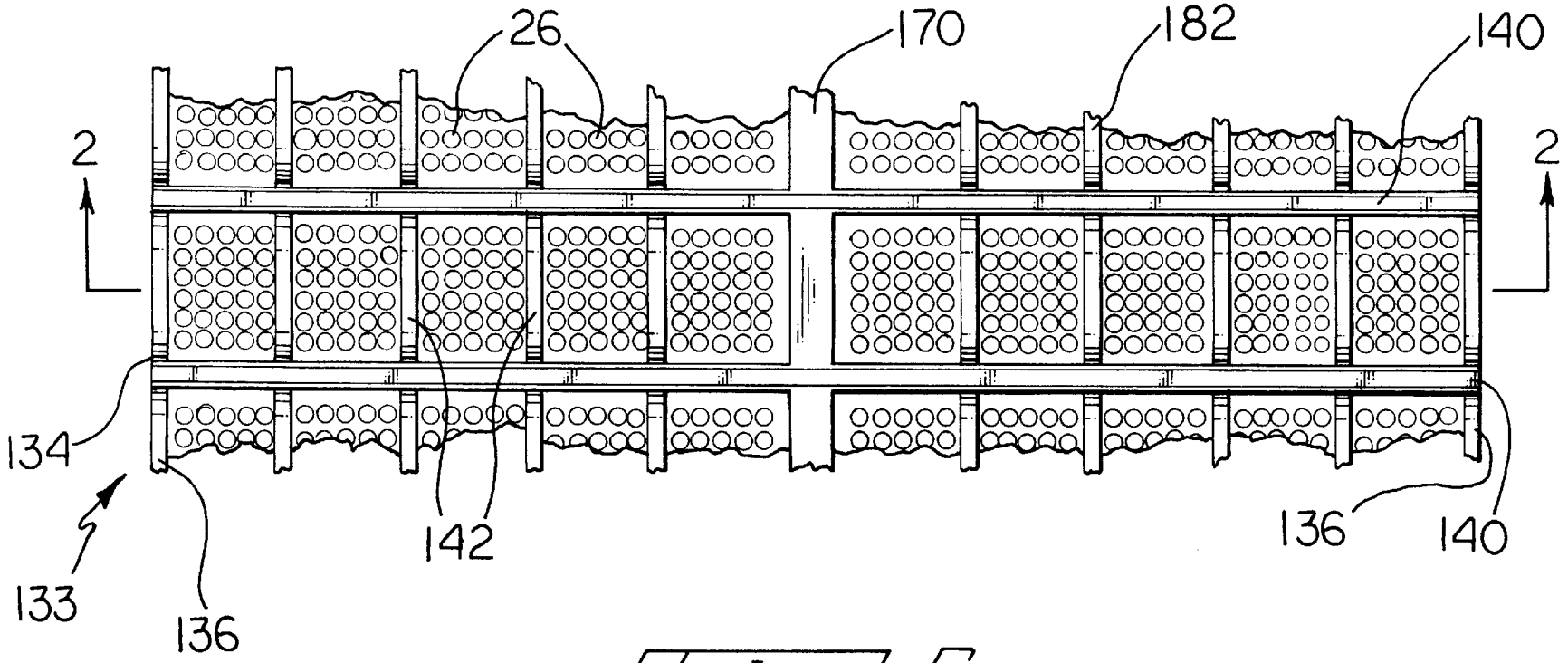
FIG. 6 is an enlarged fragmentary under plan view of a portion of the pre-cast concrete building module incorporated in the floor of the building illustrated in FIG. 3.

The floor panels 12 also each includes a plurality of longitudinally spaced apart, laterally extending, additional reinforcing ribs or partial arches 182 having one planar side 184 integrally formed with the cavity forming side 124 of the panel 120 and an opposite concave side, generally designated 186. Each rib has a rib end 188 of a predetermined thickness 190 which is the same thickness as the rib ends 148. The opposite terminal ends 192 each have a thickness, in a direction away from the panel surface 124, identical to the reduced thickness 154 of central portion 152. When the panels 12 are disposed in abutting relation as illustrated in FIG. 3, the adjacent ends 154 will abut and will cooperate with the one-half arch 182 of the adjacent panel to form a complete arch for transmitting bending forces exerted on the bending panel 120 along the edge portion of a panel 120 to the adjacent ones of the secondary beams 140 on adjacent abutting panels.

The stresses and forces 156 on the central core base 122 of the floor panels 120 between the secondary beams 140 are transmitted to the frame 133 by the reinforcing ribs 142.

The stresses and forces 191 exerted on the core face 122 laterally outwardly of the secondary beams 140 will be transmitted laterally inwardly to the adjacent secondary beams 140 of adjacent panels 12.

The concavities 126 are only formed in the portions of the panels 120 not including the beams 136, 140 or 170 or parabolic beams 142 and 182.

THE OPERATION

A building 18 is constructed of a plurality of abutting concrete building wall modules 10 vertically disposed on a suitable ground embedded concrete foundation F with the secondary end members 38 being coupled together via bolts 11 or the like. The cavities 26 formed in the panels 20 substantially reduce the weight of the units 10. The parabolic reinforcing arches or ribs 42 distribute any bending forces 56 on the central portion of the concrete panels 20 and the mid-portion 52 of the arches 46 laterally outwardly in the direction of the arrows 58 as stresses on the frame 33 and more particularly on the secondary frame beams 38 and 40.

The building floor 16 is constructed of a plurality of abutting floor panel modules 12 which span the building walls 14 and are centrally supported the underlying jack posts J. The stresses and forces 156 exerted on the core face 122 of the floor panels 126 are transmitted to the frame 133, and more particularly to the longitudinally extending secondary beams 138 and 140 by the reinforcing ribs 142.

ALTERNATE EMBODIMENT

Figures 8, 9, 10, 11:
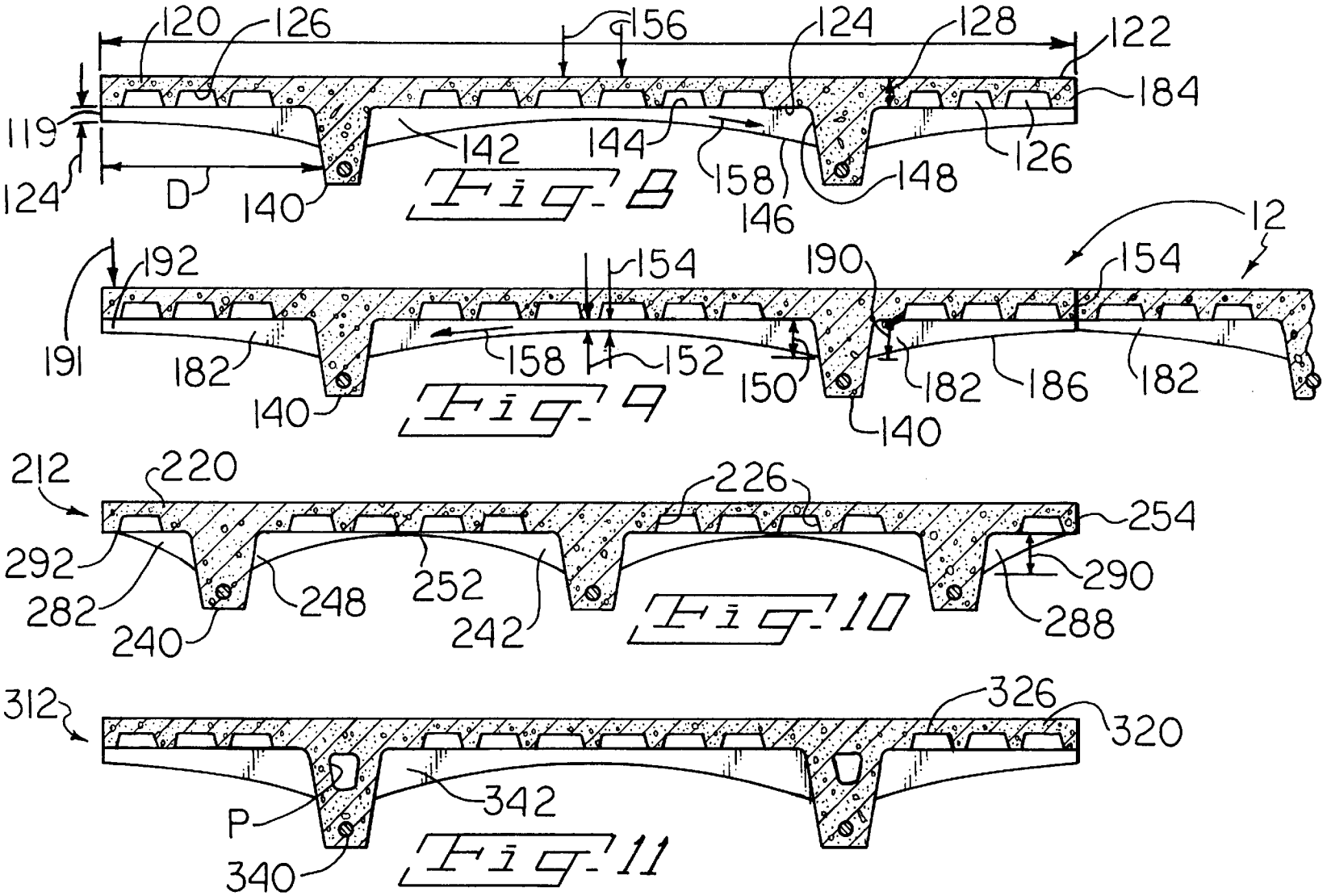
FIG. 8 is an enlarged sectional end view of one of the building modules for the floor, taken along the line 8—8 of FIG. 3.
FIG. 9 is an enlarged sectional end view, taken along the line 9—9 of FIG. 3, more particularly illustrating the abutting edges of adjacent abutting floor modules.
FIG. 10 is an enlarged sectional end view, similar to FIG. 8, of a slightly modified construction of a floor building module.
FIG. 11 is a sectional end view, similar to FIG. 8, illustrating another embodiment of a floor module.

The embodiment illustrated in FIG. 10, generally designated 212, is generally similar to the floor unit 12 and generally similar parts will be referred to by generally similar reference characters proceeded by the number "2".

The floor unit 212 differs from the floor unit 12 in that the thickness of the central rib portion 252 and terminal ends 248 and 292 of reinforcing ribs 242 and 282, respectively, is substantially less than the thickness 154 of the central portion 152 of ribs 142 and the thicknesses 150 and 190 of ribs 142 and 182, respectively. Also, this embodiment includes three parallel secondary beams 240.

ALTERNATE EMBODIMENT

Another slightly further modified embodiment, generally designated 312 is illustrated in FIG. 11 and includes a floor unit, which is similar in many respects to the floor unit 12 and generally similar parts will be referred to by generally similar reference character preceded by the reference character "3". The unit 312 differs from the unit 12 in that hollow hot water receiving pipes P are disposed in the secondary beams 140 and main beams 136 for receiving hot water which heats the floors in the building 18. The pipes P are embedded in the unit before the concrete is cast.

ALTERNATE EMBODIMENT

Figure 12:
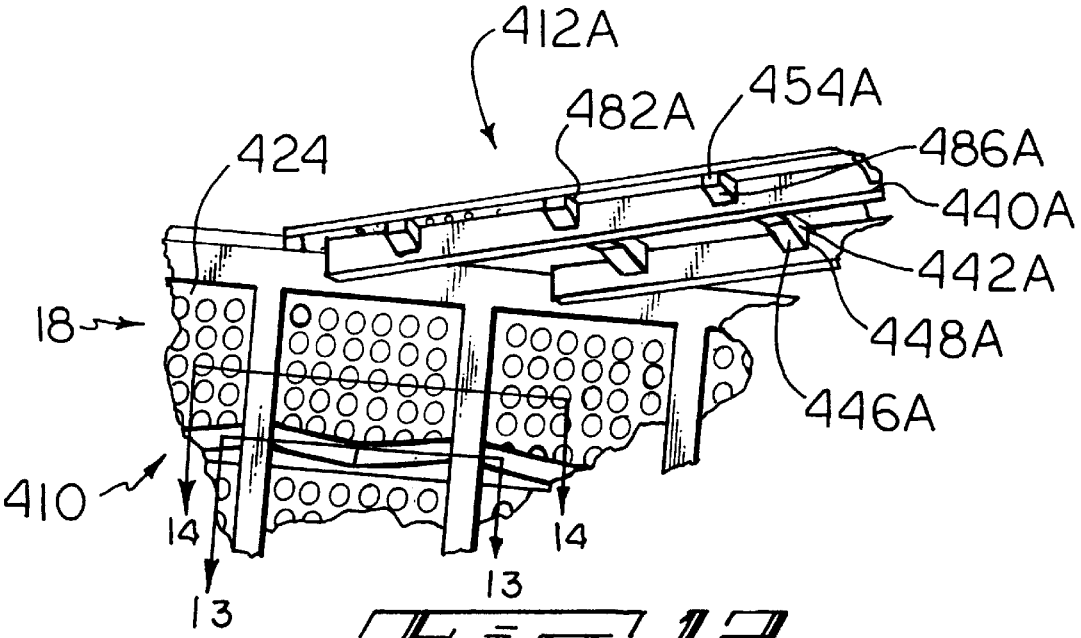
FIG. 12 is a fragmentary perspective view, similar to FIG. 1, of a slightly modified construction which can be incorporated in either a wall or floor module.
Figure 13:
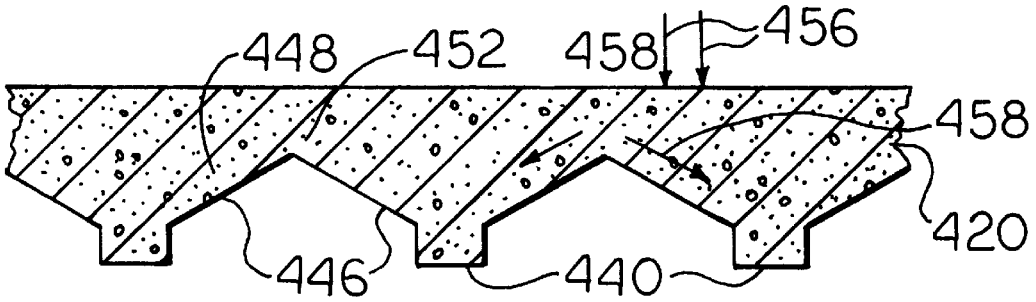
FIG. 13 is a sectional end view, taken along the line 13—13, similar to FIG. 12.
Figure 14:
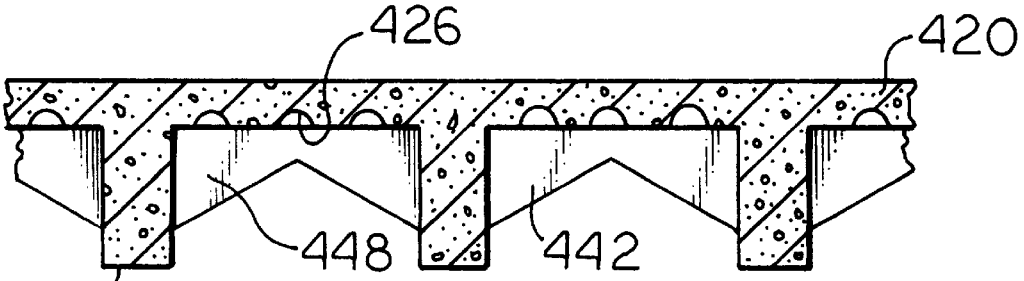
FIG. 14 is a sectional end view, taken along the line 14—14 of FIG. 12.

The embodiment illustrated in FIGS. 12–14 includes slightly modified wall and floor building modules, generally designated 410 and 412, respectively, which are similar in many respects to the wall and floor modules 10 and 12 respectively, and generally similar parts will be referred to by generally similar reference characters preceded by the reference character "4". The wall modules 410 differ from the wall modules 10 and in that the reinforcing ribs or arches 442 each have, rather than a parabolic surface 46, a pair of planar rib surfaces 446 which diverge in a direction outwardly away from the panel 420 and include rib end portions 448 integral with the secondary beams 440 and central reduced thickness portions 452 integral with the panel surface 424. The reinforcing ribs 442 distribute forces 456 exerted on the wall panels 420 in a laterally outwardly direction, represented by the arrows 458 as stresses on the secondary beams 440.

The floor modules 412 each includes reinforcing ribs 442 each having a pair of planar rib surfaces 446A which downwardly diverge away from the horizontally disposed floor panels 420A and include rib ends 448A integral with the secondary beams 440A. The planar rib surfaces 446 are joined at reduced thickness apex portion 452A integral with the panel surface 424A. The additional reinforcing ribs 482A also include a planar surface 486A and terminal ends 454A which abut the terminal end of an abutting floor module 412A.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A pre-cast one-piece concrete building module comprising:

a concrete frame including a pair of longitudinally spaced apart, laterally extending concrete main beams, a plurality of longitudinally extending, laterally spaced apart concrete secondary beams integrally spanning said main beams;

a flat concrete core, of a predetermined width and length, integrally spanning said main beams and said secondary beams and including a first side provided with a plurality of spaced apart concavities formed therein; and at least one, laterally extending concrete reinforcing rib, integral with said core, disposed longitudinally between said main beams and having opposite rib ends of a predetermined thickness, in a direction away from said core, integrally coupled to said secondary beams, and an intermediate rib portion, integral with said first side of said core and disposed between said rib ends, of a lesser predetermined thickness, in a direction away from said core, substantially less than said predetermined thickness;

said rib including first and second opposite sides, said first side of said rib having a planar face integrally mated with said first side of said core and said second side of said rib having a parabolic shaped surface which spans said secondary beams.

2. A pre-cast one-piece concrete building module comprising:

a concrete frame including a pair of longitudinally spaced apart, laterally extending concrete main beams, a plurality of longitudinally extending, laterally spaced apart concrete secondary beams integrally spanning said main beams;

a flat concrete core, of a predetermined width and length, integrally spanning said main beams and said secondary beams and including a first side provided with a plurality of spaced apart concavities formed therein; and at least one, laterally extending concrete reinforcing rib, integral with said core, disposed longitudinally between said main beams and having opposite rib ends of a predetermined thickness, in a direction away from said core, integrally spanning to said secondary beams, and an intermediate rib portion between said rib ends of a lesser predetermined thickness, in a direction away from said core, substantially less than said predetermined thickness;

said rib comprising an arch provided with a parabolic surface which is spaced from said core and spans adjacent ones of said secondary beams.

3. A one-piece concrete building module comprising:

a concrete panel including a central portion having a plurality of concavities formed therein, and a perimetrical edge extending about the entire perimeter of said panel; and a perimetrically continuous concrete frame, disposed at said perimetrical edge including spaced apart confronting frame portions, integral with said panel; and reinforcing concrete arch means, integrally spanning said frame portions, for reinforcing said module including a mid-portion integral with said central portion of said panel;

said arch means including means for transmitting any external forces transmitted to said central portion of said concrete panel and said mid-portion of said arch means as stresses on said frame;

said arch means comprising a rib including one face integrally abutting said panel and an opposite face having a concave surface spanning said confronting frame portions.

4. A pre-cast one-piece concrete building module comprising:

a concrete frame including a pair of longitudinally spaced apart, laterally extending concrete main beams, a plurality of longitudinally extending, laterally spaced apart concrete secondary beams integrally spanning said main beams;

a flat concrete core, of a predetermined width and length, integrally spanning said main beams and said secondary beams and including a first side provided with a plurality of spaced apart concavities formed therein; and at least one, laterally extending concrete reinforcing rib, integral with said core, disposed longitudinally between said main beams and having opposite rib ends of a predetermined thickness, in a direction away from said core, integrally coupled to said secondary beams, and an intermediate rib portion, integral with said first side of said core and disposed between said rib ends, of a lesser predetermined thickness, in a direction away from said core, substantially less than said predetermined thickness;

said rib including first and second opposite sides, said first side of said rib having a planar surface integrally mating with said first side of said core, said second side of said rib having a pair of planar surface sections which diverge laterally outwardly away from said intermediate rib portion, in a direction away from said first side of said core, and terminate at said secondary beams.

5. The one-piece concrete building module set forth in claim 4 including a plurality of said concrete reinforcing ribs disposed in longitudinally spaced relation between said main beams.

6. A pre-cast one-piece concrete building module comprising:

a concrete frame including a pair of longitudinally spaced apart, laterally extending concrete main beams, a plurality of longitudinally extending, laterally spaced apart concrete secondary beams integrally spanning said main beams;

a flat concrete core, of a predetermined width and length, integrally spanning said main beams and said secondary beams and including a first side provided with a plurality of spaced apart concavities formed therein; and at least one, laterally extending concrete reinforcing rib, integral with said core, disposed longitudinally between said main beams and having opposite rib ends of a predetermined thickness, in a direction away from said core, integrally coupled to said secondary beams, and an intermediate rib portion between said rib ends of a lesser predetermined thickness, in a direction away from said core, substantially less than said predetermined thickness; and a third laterally extending concrete main beam longitudinally disposed between said pair of concrete main beams and integrally spanning said width of said flat concrete core and integrally coupled to said secondary beams;

each of said pair of main beams having a predetermined mass and spanning said width of said flat concrete core; said third concrete beam includes a substantially greater predetermined mass which is substantially greater than said predetermined mass of each of said pair of main beams.

7. The one-piece concrete building module set forth in claim 6 wherein said flat concrete core includes lateral edges spaced apart said predetermined width and longitudinal edges spaced apart said predetermined length; said secondary beams each being disposed inwardly of an adjacent one of said lateral edges a predetermined distance; and including an additional laterally outward reinforcing rib means, disposed laterally in alignment with said laterally extending concrete reinforcing rib; said additional outward reinforcing rib means having first and second opposed sides, said first side being integral with said core; said additional outward reinforcing rib means including laterally inner ends of said predetermined thickness between said first and second opposed sides thereof integral with an adjacent one of said secondary beams and a laterally outer terminal end portion, flush with said lateral edge; said laterally outer ends each having a thickness between said first and second opposed sides thereof substantially equal to said lesser predetermined thickness.

8. The one-piece concrete building module set forth in claim 7 wherein said secondary beams each include an elongate passage extending the length thereof for passing a temperature control medium therethrough.

9. The one-piece concrete building module set forth in claim 7 wherein said second opposed surface of said laterally outward, reinforcing rib means follows a parabolic curve.

10. A one-piece concrete building module comprising:

a concrete panel, having a predetermined thickness, including a central portion, and a perimeter edge portion extending about the entire perimetrical edge of said panel; and a plurality of cavities formed in said central portion of a depth less than said predetermined thickness;

a perimetrically continuous concrete perimeter frame, mounted on said perimeter edge portion of said panel, having a greater predetermined thickness which is greater than said predetermined thickness and opposite confronting frame portions disposed in confronting relation with each other;

a reinforcing concrete rib having a central portion of a second predetermined thickness integral with said central portion, and opposite terminal end portions having a second greater predetermined thickness, greater than said second predetermined thickness, integral with opposing confronting portions of said concrete frame;

said rib including a first face coupled to said central portion and a second face, opposite said first face and having a bowed contour, spanning said opposing confronting portions of said concrete frame.

11. The one-piece concrete building module set forth in claim 10 wherein said contour is parabolic.

12. The one-piece building module set forth in claim 10 wherein said reinforcing rib comprises an arch.

13. The one-piece building module set forth in claim 10 wherein said second face includes first and second planar face portions which span said opposing confronting frame portions and converge in a direction toward said concrete panel.

14. A pre-cast one-piece concrete building unit for being assembled with one or more similar concrete building units to form a building construction comprising:

a concrete building slab having a face provided with a plurality of cavities formed therein and including a perimeter having laterally spaced apart terminal side edge portions and longitudinally spaced apart end edge portions spanning said terminal side edge portions;

a perimetrically continuous perimeter concrete frame integral with said slab at said perimeter including a pair of laterally extending, longitudinally spaced apart main concrete end beams integrally formed with said longitudinally spaced apart end edge portions, and a pair of laterally spaced apart, longitudinally extending, secondary concrete beams integrally spanning said main concrete beams, integrally formed with said laterally spaced apart terminal side edge portions; and at least one laterally extending, reinforcing concrete rib disposed between said main concrete end beams and having opposed, laterally extending sides, one of said sides being integral with said face of said slab and the other of said sides being spaced from said face of said slab and having a concave surface, spaced from said face of said slab, spanning said secondary concrete beams.

15. The pre-cast one-piece concrete building unit set forth in claim 14 wherein said concave surface is parabolic.

16. The pre-cast one-piece concrete building unit set forth in claim 14 wherein said concave surface includes first and second planar surface sections which diverge laterally outwardly in a direction away from said concrete building slab.

17. The pre-cast one-piece concrete building unit set forth in claim 14 including a plurality of laterally spaced apart, longitudinally extending concrete building studs disposed between said secondary beams and formed integral with said face of said slab and integral with said main concrete end beams.

18. The pre-cast one-piece concrete building unit set forth in claim 17 said laterally extending, concrete reinforcing rib is integral with said face of said slab and having end portions of predetermined thickness integral with adjacent ones of said studs and central portions intermediate said end portions of a substantially reduced thickness.

19. The pre-cast one-piece concrete building unit set forth in claim 18 wherein said concave surface on each of said reinforcing ribs is parabolic.

20. The pre-cast one-piece concrete building unit set forth in claim 19 wherein said concrete rib extends said side and end portions of said slab, said secondary beams being integral with said laterally spaced apart terminal side portions of said slab and including a plurality of longitudinally spaced apart concrete reinforcing ribs having said parabolic surface disposed between and integrally coupled to each pair of adjacent ones of said studs.

21. The pre-cast one-piece concrete building unit set forth in claim 20 including a plurality of reinforcing rods embedded in each of said main beams, said secondary beams, and said studs to strengthen said unit.

22. In a pre-cast concrete building panel having a concrete grid frame of a first predetermined thickness and an integral, generally planar concrete wall of substantially lesser thickness spanning said grid frame, the improvement comprising:

a plurality of cavities formed in said concrete wall for forming wall sections having a still lesser thickness less than said substantially lesser thickness;

at least one reinforcing rib, integral with said wall and integrally spanning said grid frame, having opposed ends integral with said grid frame and an intermediate portion between said ends; and first and second opposed sides between said ends, said first side being integral with said concrete wall;

said second side comprising a smooth uninterrupted continuous concave surface spanning said opposed terminal ends integral with said grid frame;

the distance between said first and second sides of said opposed ends being a predetermined distance, the distance between said first and second sides of said intermediate portion being a substantially lesser distance substantially less than said predetermined distance between said first and second sides of said opposed ends;

said grid frame including longitudinally spaced apart, laterally extending main beams, and laterally spaced apart longitudinally extending secondary beams integrally spanning said main beams;

said concrete wall having longitudinally extending lateral side portions provided with lateral edges and longitudinally spaced apart end portions; said main beams being integral with said longitudinally spaced apart end portions and including terminal ends flush with said lateral edges.

23. The building panel set forth in claim 22 wherein said secondary beams are integral with said lateral side portions and disposed flush with said lateral edges.

24. The building panel set forth in claim 22 wherein said secondary beams are disposed laterally inwardly of said lateral edges; said panel further including additional reinforcing rib means integral with each of said secondary beams and disposed in lateral alignment with said one reinforcing rib;

said reinforcing rib means having a laterally inner end integral with one of said secondary beams, an outer end flush with one of said lateral edges, and first and second opposed sides extending between said laterally inner and outer ends;

the distance between said first and second sides of said laterally inner ends being substantially equal to said predetermined distance; and the distance between said first and second sides of said laterally outer end being substantially equal to said lesser predetermined distance.

25. A pre-cast one-piece concrete building module comprising:

a concrete panel, of predetermined thickness, having a perimeter and a pair of opposed faces which are substantially equidistantly spaced apart a predetermined distance and span said perimeter;

one of said faces including a plurality of cavities formed therein to form panel sections having a lesser predetermined thickness and including marginal end and side portions about said perimeter of said one face;

a concrete frame, integrally formed with said one face, having a predetermined thickness greater than said predetermined thickness including longitudinally spaced apart, laterally extending main beams integrally coupled to said marginal side portions of said one face, a plurality of laterally spaced apart secondary concrete beams integrally coupled to said marginal end portions of said one face and integrally spanning said main beams; and a plurality of longitudinally spaced apart concrete reinforcing ribs having opposite terminal rib ends of a predetermined thickness integrally coupled to each pair of adjacent ones of said secondary concrete beams and central portions, between said terminal rib ends of a substantially lesser thickness than said predetermined thickness of said terminal rib ends integrally coupled to said one face of said panel and to said secondary beams;

said reinforcing rib having a planar face integral with said one face and an opposed, concave surface, spaced from said one face and spanning said rib ends and said secondary beams.

26. The pre-cast one-piece concrete building module set forth in claim 25 wherein said concave surface is parabolic.

27. The pre-cast one-piece concrete building module set forth in claim 25 wherein said concave surface includes planar surfaces which diverge laterally outwardly in a direction away from said one face of said panel.

28. The pre-cast one-piece concrete building module set forth in claim 25 wherein said marginal side portions include a pair of longitudinally extending, lateral edges, said main concrete beams being integrally coupled to said marginal end portions and including opposed ends disposed flush with said lateral edges.

29. The pre-cast one-piece concrete building module set forth in claim 28 wherein the laterally outermost ones of said secondary concrete beams include laterally outer surfaces flush with said lateral edges.

30. The pre-cast one-piece concrete building panel set forth in claim 28 wherein the two laterally outermost ones of said secondary beams are disposed laterally inwardly of said lateral edges; and further including additional reinforcing rib means disposed in lateral alignment with each of said plurality of concrete reinforcing ribs; each of said additional reinforcing rib means including a laterally inner end, integral with one of said secondary beams, and a laterally outer end disposed flush with one of said lateral edges; each of said reinforcing rib means including first and second opposed surfaces extending between said laterally inner and laterally outer ends of said additional reinforcing rib means, said first surface of said additional reinforcing rib means being integral with said one face, the distance between said first and second opposed surfaces of said laterally inner end of said additional reinforcing rib means being substantially equal to said predetermined thickness of said reinforcing ribs and the distance between said first and second opposed surfaces of said laterally outer end being substantially equal to said substantially lesser thickness of said reinforcing ribs.

31. The building module set forth in claim 30 therein said second surface of said additional reinforcing rib means follows a parabolic curve.

32. The building module set forth in claim 30 wherein said main beams comprise three longitudinally spaced apart concrete beams having terminal ends flush with said lateral edges.

33. The building module set forth in claim 30 wherein said second surface of said additional reinforcing rib means comprises a pair of planar surfaces which diverge outwardly in a direction away from said concrete panel.

* * * * *